United States Patent [19]

Ushikoshi

[11] Patent Number: 4,523,857

[45] Date of Patent: Jun. 18, 1985

[54] MULTI-FUNCTION ANALOG ELECTRONIC TIMEPIECE

[75] Inventor: Kenichi Ushikoshi, Suwa, Japan

[73] Assignee: Kabushiki Kaisha Suwa Seikosha, Tokyo, Japan

[21] Appl. No.: 527,893

[22] Filed: Aug. 30, 1983

[30] Foreign Application Priority Data

Aug. 31, 1982 [JP] Japan ..... 57-151072

[51] Int. Cl.[3] ..... G04F 5/00

[52] U.S. Cl. ..... 368/157; 368/160; 368/109; 368/107

[58] Field of Search ..... 368/110, 111, 112, 107, 368/157, 160, 156, 76, 80

[56] References Cited

U.S. PATENT DOCUMENTS 3,884,035 5/1975 Jeannet et al. ..... 368/110
4,211,066 8/1980 Kusumoto et al. ..... 368/113
4,270,197 5/1981 Minowa ..... 368/102
4,364,669 12/1982 Thoenig et al. ..... 368/111
4,440,502 4/1984 Kanno ..... 368/80

*Primary Examiner*—Bernard Roskoski
*Attorney, Agent, or Firm*—Blum Kaplan Friedman Silberman & Beran

[57] ABSTRACT

The analog electronic timepiece has a plurality of functions, each driven independently by a dedicated step motor. A stem, pullable to three positions and a plurality of pushbuttons control operation. Each indicator hand may be set to zero independently by operation of an external button when the electronic circuits indicate that the respective hand should be at the zero position. A single frequency signal source and divider network provide frequency signals to all functions. Phase shifting circuits assure that driving signals to the independent motors are never concurrent.

17 Claims, 7 Drawing Figures

MULTI-FUNCTION ANALOG ELECTRONIC TIMEPIECE

BACKGROUND OF THE INVENTION

This invention relates generally to an analog electronic timepiece of the type having a step motor to drive hands and more particularly to a multi-function analog timepiece including a supplemental function such as a chronograph display. Recently, digital electronic timepieces and stopwatches have been developed having not only a measuring function of the sum total of elapsed time but also including a split function, that is, a measuring function of intermediate elapsed time. This is possible because electronic circuits are more integrated. Further, a conventional chronograph timepiece having a mechanical analog display has the hand position reset by using a heart-shaped cam element. However, the mechanism is so complicated that an analog chronograph having a split display can not be successfully achieved except for a timepiece which provides a special hand for recording split times as well as the conventional chronograph hand or hands. Also, in multi-functional watches providing both timepiece and, for example, chronograph functions, it is difficult to comprehend the many hands which appear on the face and it is difficult to correct the positions of the hands for accurate operation.

What is needed, is a small sized electronic analog timepiece having a plurality of functions which is simple to comprehend in use and simple to set for accurate operation.

SUMMARY OF THE INVENTION

Generally speaking, in accordance with the invention, an analog electronic timepiece having a plurality of functions and especially suitable for easy comprehension and simple adjustment is provided. The timepiece includes a plurality of timekeeping functions. Each function is driven independently by a dedicated step motor. Thus, for example, a chronograph timepiece may include a motor for timekeeping and three motors dedicated to the chronograph function. A stem, pullable to three positions and a plurality of pushbuttons control operation. Each hand of the chronograph may be set to zero by operation of an external button when the electronic circuits indicate that the respective hand should be at the zero position. Thus an accurate position for the hand is readily assured. A single frequency signal source and divider provide frequency signals to all functions. Phase shifting circuits assure that driving signals to the independent motors are never concurrent and peak current drain on the power source is reduced.

Accordingly, it is an object of this invention to provide an improved analog electronic timepiece which provides supplemental functions which are easy to operate and comprehend.

Another object of this invention is to provide an improved analog electronic timepiece with supplemental functions which are accurate and easily adjusted by the user.

A further object of this invention is to provide an improved analog electronic timepiece using independent motors for supplemental functions and timekeeping and which maintains a low peak current drain.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1(*b*) is a circuit diagram of a portion of the diagram of FIG. 1(*a*);

DESCRIPTION OF THE PREFERRED EMBODIMENTS

This invention relates to an analog electronic timepiece having many functions such as chronograph display.

The purpose of this invention is making it easy to understand operation of an analog timepiece which provides many functions. In particular, this invention eliminates confusion which is brought about by combinations of electronic circuits and mechanical functions when a user operates the timepiece.

Recently, digital electronic timepieces and stopwatches have been developed having not only a measuring function of the sum total of elapsed time but also include a split function, that is, a measuring function of intermediate elapsed time. This is possible because electronic circuits are more integrated.

Usually a chronograph timepiece having a mechanical analog display resets its hand position by using a heart shape cam element. However, the mechanism is so complicated that an analog chronograph having split display is not achieved except for a timepiece which has not only an ordinary chronograph hand but an exclusive split hand.

In a conventional digital timepiece, when a chronograph is operated by two buttons, that is start/stop button and lap/reset button, the user can not understand what is measured. Therefore, in such a timepiece usually some display of an operational mode, such as LAP (split) display is performed during measurement.

In accordance with this invention, operation of the chronograph function is easy to understand. How external operational members by which the chronograph function can be operated without split display cooperate with electronic circuits is described in detail with reference to the following embodiment.

Figure 1A:
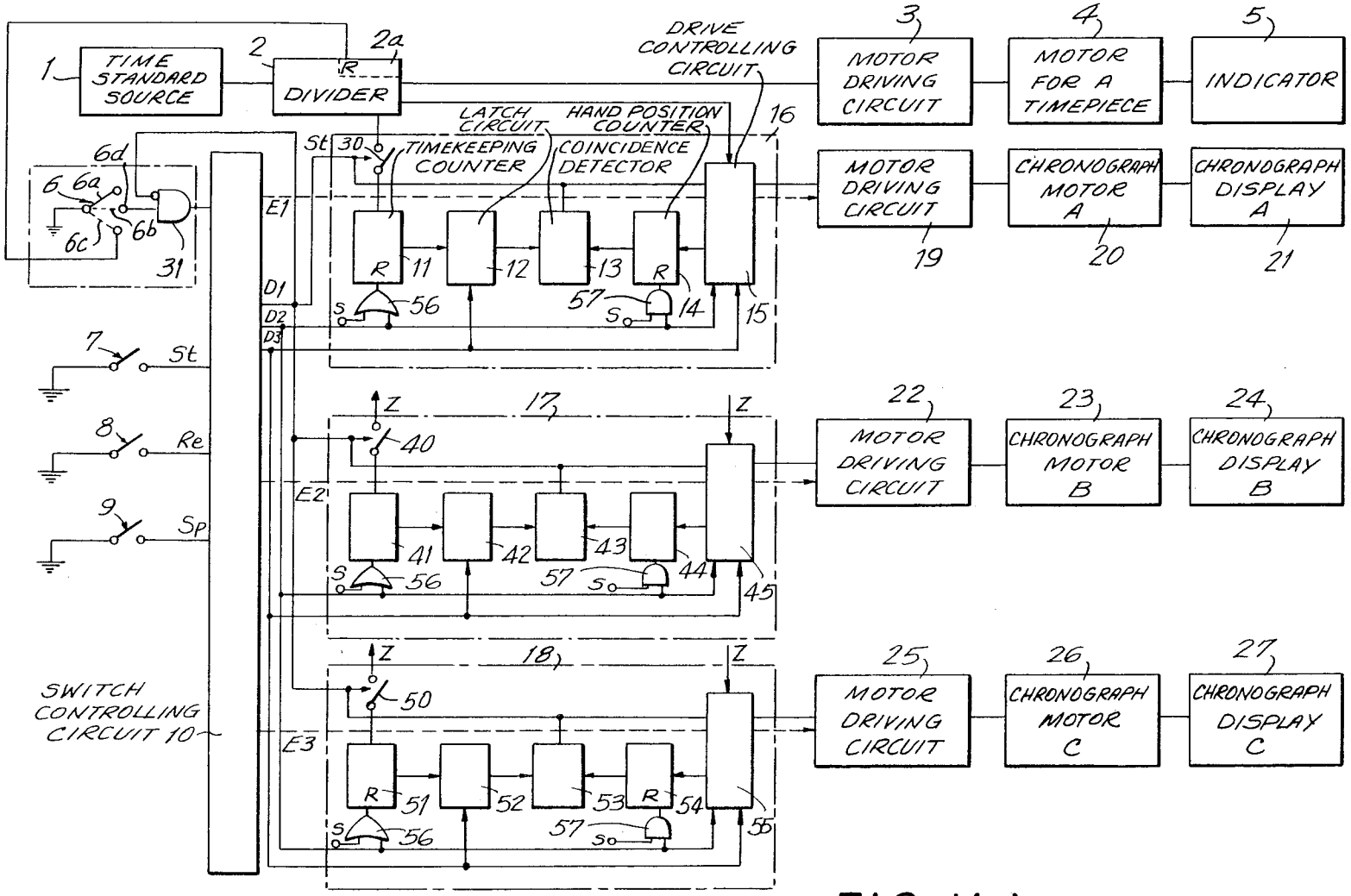
FIG. 1(*a*) is a functional block diagram of an analog electronic timepiece in accordance with the invention.
Figure 1B:
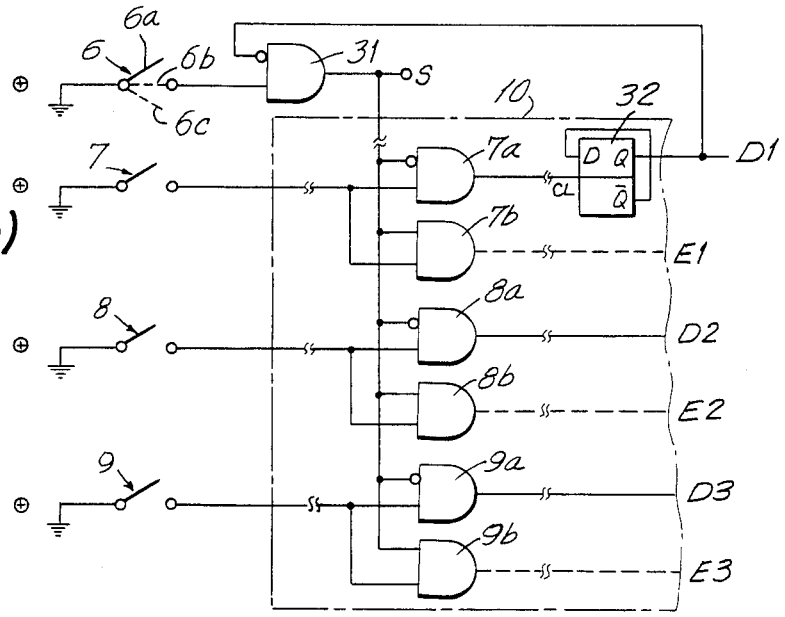
Figure 2:
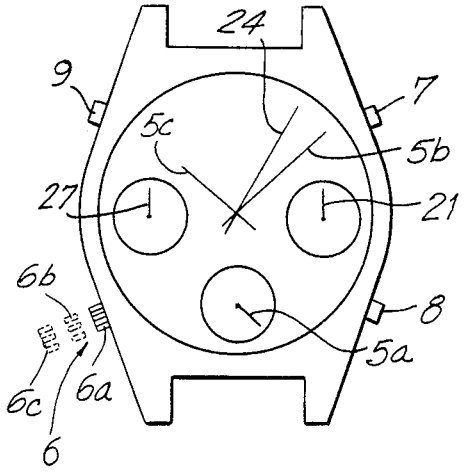
FIG. 2 is an external face view of an analog electronic timepiece in accordance with the invention.

FIG. 1(*a*) is a block diagram showing one embodiment of this invention. FIG. 1(*b*) is a more detailed circuit diagram of switches in FIG. 1. FIG. 2 is a front view of a timepiece showing the position of the external operational members and the hands of the indicator.

With reference to FIGS. 1 and 2, an analog quartz timepiece in accordance with this invention comprises a basic watch unit including a time standard source 1, divider 2, motor driving circuit 3, motor 4 for a timepiece, and indicator 5, comprised of, as is well known, an hour hand 5*c*, minute hand 5*b* and second hand 5*a*. In the present embodiment, the timepiece has a structure wherein respectively independent motors are used for driving the chronograph function.

The timepiece of FIG. 1 includes switches 6,7, 8 and 9 which are respectively corresponding to the external operational stem 6 and push buttons 7, 8 and 9 in FIG. 2. Further, switch controlling circuit 10, and electronic measuring circuits for chronograph measurement 16, 17 and 18 are provided. The electronic measuring circuits 16, 17 and 18 comprise time keeping counters 11, 41, 51, latch circuits 12, 42, 52, coincidence detectors 13, 43, 53, hand position counters 14, 44, 54 and drive controlling circuits 15, 45, 55 respectively. Compared to the measuring circuits of a digital watch, hand position counters 14, 44 and 54 are added in this invention.

The input signals are applied to timekeeping counters 11, 41, 51 from a divider 2 by operating switches 30, 40, 50 by the output of the switch controlling circuit 10.

Motor driving circuits 19, 22 and 25 operate independently of one another and drive chronograph motor A20, chronograph motor B23 and chronograph motor C26, respectively. Chronograph indicators A21, B24 and C27 have hands which operate independently and indicate the elapsed time in different time units.

In this example, for example, chronograph indicator A21 can measure the elapsed time in 1/10th of a second units when it takes a second for the hand to complete a revolution on a dial scale graduated in ten parts.

Chronograph indicator B24 is provided at the center of the dial and its hand can be replaced in position by the small second hand 5*a* for a timepiece. It takes one minute for the hand of chronograph indicator B24 to complete a revolution, the same as the second hand. And the dial scale is graduated in sixty parts so that chronograph indicator B24 can measure the elapsed time in second units.

As for chronograph indicator C27, it takes 30 minutes for the hand to complete a revolution. The hand moves by a step once each minute on a dial scale graduated in thirty parts, so that elapsed time can be measured up to thirty minutes. The maximum of elapsed time to be measured is changeable in alternative embodiments, for example, to sixty minutes by changing the step of the hand and the graduations of the scale. The divided signals inputted to the electronic measurement circuits 16, 17, 18 from the divider 2 correspond to each measured unit of elapsed time.

Operation of switches of the timepiece in accordance with the invention is now described. Switch 6 in FIG. 1(*a*) operates with the external operational stem 6 in FIG. 2. Switches 6, 6*a*, 6*b*, 6*c*, 7, 8,9 in FIG. 1(*a*) correspond to the external operational stem 6, 6*a* at the normal position, 6*b* at the first pulled-out position, and 6*c* at the second pulled-out position in FIG. 2. Switch 6 is open at the normal position 6*a* and at the second pulled-out position 6*c*, while it is closed at the first pulled-out position 6*b*. Switches 7, 8,9, which correspond to push buttons, 7, 8, 9 in FIG. 2, respectively become in the ON condition at the instant of pushing the corresponding push buttons with the fingers, and in the OFF condition at the instant of releasing the fingers as a result of elastic force of a coil spring at the buttons or by springs on a lever in the movement. Operation of these switches is described by the example of a so-called push switch.

(i) Operation of switches 6, 7, 8,9 when the external operational stem is at the normal position 6*a* is now described. Referring in particular to FIG. 1(*b*), showing a part of the switch controlling circuit 10, in greater detail, the switch terminal 6*d* is in a Low condition, and output of an AND gate 31 is Low regardless of the level of the other input $D_1$ of the AND gate 31, thereby permitting AND gates 7*a*, 8*a*, 9*a* to be enabled for receiving other inputs. When the inputs are provided for switches 7, 8, 9, respectively, gate 7*a* outputs a signal $D_1$ passing through a D-type flip-flop 32 (hereinafter referred to as FF); gate 8*a* outputs a signal $D_2$ and gate 9*a* outputs a signal $D_3$.

(ii) Operation of switches 6, 7, 8 and 9 when the external operational stem is at the first pulled-out position 6*b* is described. The signal of gate 31 is controlled in response to a High or Low level of outputted signal $D_1$ and High or Low level of switch 6*b*. When signal $D_1$ is Low, the output of gate 31 becomes High and Gates 7*a*, 8*a*, 9*a* do not actuate since the inputted signals thereto become Low. At the same time AND gates 7*b*, 8*b* and 9*b* are enabled to pass signals from switches 7, 8 and 9. In this condition, when switches 7, 8 and 9 are closed, gate 7*b* outputs a signal $E_1$, gate 8*b* outputs a signal $E_2$ and gate 9*b* outputs a signal $E_3$ respectively. Signals $E_1$, $E_2$ and $E_3$ are applied to motor driving circuits 19, 22, 25 through drive controlling circuits 15, 45, 55 in electrical measuring circuits 16, 17, 18, as shown in FIG. 1(*a*), respectively.

(iii) When the external operational stem is pulled-out further at the second pulled-out position 6*c*, the switch 6 is open. In this state, operation of the chronograph is the same as in the stem position 6*a*. When the switches 7, 8 and 9 are closed, gate 7*a*, gate 8*a* and a gate 9*a* deliver the signals $D_1$, $D_2$ and $D_3$, respectively.

(iv) How the hand of the chronograph indicator is related to the hand for time display will be described at each switch position 6*a*, 6*b* and 6*c*.

(v) How the functions are made at the switch portion 6*b* instead of all functions at the switch portions 6*b* and 6*c* will be described.

Here, the operation of switches 7, 8 and 9 is further described in detail corresponding to each position of the external operational stem 6 in accordance to the above items (i) to (v).

A wearer of this watch knows the conventional time by the analog display. As shown in FIG. 1, the frequency signal from an oscillator 1 is divided by a divider 2 and shaped by a motor driving circuit 3. Then, the motor 4 for time display is driven by the shaped signal to operate the time display 5, which is well known. A minute hand 5*b* and an hour hand 5*c* are provided in the center of the dial and a supplemental second hand 5*a* is provided as shown in FIG. 2.

As for chronograph operation, switch 6 is closed at the first pulled-out position 6*b* and the switch 6 is open at the second position 6*c* for making corrections in the time displayed by indicators 5. The hour hand and minute hand for indicating conventional time are corrected by rotating the external operational stem clockwise or counter clockwise at the second pulled-out position 6*c*, which function is performed via a changeover mechanism (not shown).

The chronograph function is now described according to the pulling position of the external operation stem. First of all, the chronograph function is explained as follows, in the case of item (i) where switch 6 is in the normal position *6a*. Inputted signals of switches 7, 8 and 9 are applied to the switch control circuit 10. Actuation of switch 7 provides a function of start and stop of measurement of elapsed time. Actuation of the switch 8 provides a function of reset of the indication of the chronograph. Actuation of the switch 9 provides a function of split time measurement.

In FIG. 1(*b*), when the push button 7 is pushed and the switch 7 is coincidently closed in the condition *6a* of switch 6, a High level signal is inputted to AND gate *7a* to be applied to FF32 as a clock signal. The signal $D_1$ delivered from one terminal Q of FF32 goes high at the moment that the first clock signal from the AND gate *7a* is received and remains in the High condition until the second clock signal is received. Then the signal $D_1$ goes Low due to the second clock signal from the AND gate *7a* and remains in the Low condition until the third clock signal is received. Subsequently, the signal $D_1$ goes High at the moment that the third clock signal is received. Namely, the clock signal is applied to the FF when switch 7 is closed. Under this condition, elapsed time is allowed to be measured at the time when the output $D_1$ is in the High condition. When output $D_1$ is Low, the chronograph is at a standstill, namely the elapsed time is stopped from being measured. Thus, a signal for starting and stopping the chronograph function in turn is produced by operating the push button 7.

Time measuring circuit 16 comprises a timekeeping counter 11, a latch circuit 12, a coincidence detecting circuit 13, a hand position counter 14, a drive controlling circuit 15 and a switch 30 which is disposed between the timekeeping counter 11 and the divider. When the switch 30 turns on, a signal whose period is the same as that for driving the motor is inputted to the timekeeping counter from the divider *2a*. The divider *2a* delivers a driving signal to the motor driving circuit 19 through the drive controlling circuit 15. The drive controlling circuit 15 outputs a signal to the hand position counter 14 of the same number of pulses as the motor driving signal inputted to the motor driving circuit 19. The latch circuit 12 normally passes the counted state of the timekeeping counter 11 and inputs this signal to the coincidence detecting circuit 13. By the coincidence circuit 13, the condition of the timekeeping counter 11 and that of the hand position counter 14 are compared. Where these conditions are different from each other, the coincidence detecting circuit 13 delivers a signal to the drive controlling circuit 15, so that the drive controlling circuit 15 selects a quick-feeding signal. When the counted values of the timekeeping counter 11 and the hand position counter 14 agree as a result of applying the quick-feeding signal, the coincidence circuit 13 delivers a signal so that the drive controlling circuit 15 selects the normal driving signal. The quick-feeding signal is provided by taking a signal at an earlier stage of the divider network 2(*a*).

The latch circuit latches the counted value of the timekeeping counter 11 at the time when a split signal is output from the switch 9. The split signal is input to the drive controlling circuit 15 simultaneously to stop delivery of the motor driving signal. Thus, the coincidence detecting circuit 13 remains in the coincident condition. When the split condition is released by the switch 9, the coincidence detecting circuit takes in the counted value of the counter 11 which is obtained by counting the output continously for the duration of time while motor driving is stopped. Under this condition, the coincidence detecting circuit 13 detects a disagreement between the timekeeping counter 11 and the hand position counter 14, and the drive controlling circuit 15 selects the quick-feeding signal. The drive controlling circuit selects the normal drive signal again at the time when the hand position counter 14 arrives at coincidence with the timekeeping counter 11 as a result of the quick-feeding signal. Thereby, the hand position of the indicator, whose movement had been stopped by the split, is adjusted to elapsing time.

Under a condition where the switch 6 is open at the position *6a*, the chronograph (hereinafter referred to as CG) is started by depressing the button 7 to close the switch 7. A signal $D_1$ actuates switch 30, in FIG. 1(*a*), and then starts counting by the timekeeping counter 11 and further operates the motor driving circuit 19 and motor A20 through the drive controlling circuit 15. Thus, a chronograph indicator A21 is driven. The elapsed time can be measured in small time units of less than 1 second. For example, it takes 1 sec for the hand to make a revolution or 0.1 sec for one step movement of the hand of the indicator. Simultaneously, the measuring counter 16 starts operation of the hand position counter 14.

Next, when output of AND gate *7a* becomes High by operating switch 7, CG is stopped. Namely, the signal $D_1$ from the switch controlling circuit 10 stops the counting by the timekeeping counter 11 and stops hand rotation of the display 21.

Operation of switch 8 is now described. Switch 8 provides the reset function of the chronograph. When switch 8 is actuated by depressing the external operational stem 8, output $D_2$ of the switch controlling circuit 10 resets the measuring counter 11 to 0 and simultaneously actuates drive controlling circuit 15, to quickly feed the hand of display A21 up to the zero position. Namely, the measuring circuit is electronically set to 0, and the hand 21 of CG indicator is mechanically quick-fed to reset in the zero-position. However, since the amount of quick-feed is determined electrically, as described above, the hand is moved only to a position where the electronic measuring circuit indicates 0. Accordingly, in FIG. 2, when the hand 21 starts rotating from a position which is not zero, the position indicated by the hand does not correspond to the counter position of the electronic circuit. Under this condition, the hand 21 would reset to an incorrect zero position. In FIG. 2, CG hands 21, 24 and 27 are rotated by such circuits as described in FIG. 1. All the functions are stopped when a battery is exchanged. In an ordinary wristwatch only one battery is used as a power source and no other supplementary power source, such as a memory means, is provided. Therefore, when exchange of the battery is completely accomplished, the electric circuitry starts operating (1) from an optional position or (2) the zero-position after resetting.

In either case, when a battery is exchanged at the time chronograph hands 21, 24 and 27 in FIG. 2 are stopped at optional positions, the memorized content of the counter of the electronic circuit is changed, so that the position indicated by the hand does not correspond to the counter position of the electronic circuit. Accordingly, another function, for correcting the position of the CG hand, is required in order to have a mechanical start position coinciding with an electrical start (reset) position. This function is described in (ii) after a descrition of the split function.

During the CG measurement, that is, while operating switch 7, if switch 9, which serves for a split function is actuated, signal $D_3$ via the switch controlling circuit 10 operates the latch circuit 12, and drive controlling circuit 15 operates so as to stop the motor 20 temporarily. As a result, the hand 21 of CG indicator is temporarily stopped. However, CG measurement in the electrical circuit is continued by timekeeping counter 11. When the split switch 9 is operated again, hand 21 of the CG indicator moves rapidly to indicate elapsed time since quick-fed driving signals are outputted from the drive controlling circuit 15 until the driving signals and the signals of the timekeeping counter 11 coincide with each other, as previously described.

Operating switches 7, 8 and 9 actuate chronograph hand 21 and simultaneously actuate electronic circuits making up chronograph measuring circuits 17, 18 and motor portions 22, 23, 25, 26. Therefore, it should be understood that the hands 24, 27 of the CG indicator are actuated like the hand 21 of the CG indicator, as stated above, except that their driving period is different from that of the hand 21. Chronograph measurement is indicated by hands 21, 24, 27.

Following is a description of the case when the external operational stem 6 is at the first pulled position 6*b*, where the function for correcting the hand position of the CG indicator is performed. Output of switch 6 becomes High or Low in response to High or Low of signal $D_1$ which is inputted to AND gate 31 to teach the CG operating condition. First, in a case where the signal $D_1$ is High while driving CG measurement, the chronograph remains operating even if switch 6 is closed, that is, the stem is pulled out to the position 6*b*. This is the same condition as the normal stem position 6*a* and is described in (iv) hereinafter.

When the chronograph is stopped and the signal $D_1$ becomes Low, AND gate 31 outputs a High signal delivered from the closed switch 6*b*. The following description is under the condition of a closed switch until the description (iv), that is, the stem is first pulled from the normal position at a time when CG is stopped.

When the external stem member 6 is first pulled to the position 6*b* and thereby the switch 6 is closed, each zero position indicated by chronograph hands 21, 24, 27 can be ready for correction. In the closed condition of switch 6, signals $E_1$, $E_2$ and $E_3$ are outputted in response to the operation of respectively independent switches 7, 8 and 9 as in the description of FIG. 1(*b*).

Here, when the switch 6 is closed, that is, the switch position is 6*b* in FIG. 1(*a*), output S of AND gate 31 becomes High and resets the measuring counters 11, 41, 51 via OR gate 56. When measuring counters 11, 41, 51 are reset, quick-feed of each motor is performed through the drive controlling circuit until hand position counters 14, 44, 54 coincide with the condition of the time measuring counters 11, 41, 51. When the conditions of both counters coincide with each other, the motor stops. As a result, it is possible to confirm clearly how far the position indicated by the hand is offset from the zero position of graduation on the dial. In a case where the hand position is out of zero position, the amount of offset is corrected by operating switches 7, 8, 9. For example, when hand position of chronograph indicator A is out of zero position, operation of switch 7 drives the chronograph motor 20 via drive controlling circuit 15 with the signal $E_1$. Output of the switch 7 is connected to a reset terminal R of the hand position counter 14 via AND gate 57. Accordingly, whenever the switch 7 actuates, the hand position counter 14 is reset and the hand position counter remains in a condition of zero position even though the motor is driven.

To describe this in more detail, when the switch 7 is temporarily closed, the switch controlling circuit 10 outputs a signal $E_1$. A high frequency signal of the divider 2 is inputted to the motor driving circuit 19 through the drive controlling circuit 19. Thus, the motor A20 rotates at least as fast as it rotates when the CG operates, or a signal which commands the motor to advance one step for one operation of the switch 7 is inputted to driving circuit 19. As a result, the hand for chronograph indicator A is displaced by one step or at a much higher frequency, whereby permitting correcting the hand position. In this way, it is possible to adjust each hand 21, 24, 27 corresponding to switches 7, 8, 9 to the zero position or an optional selected position of the chronograph independently.

A mechanical position indicating zero is determined as described above. Then, the mechanical zero-position is made coincident with a zero-postion of the electronic circuit. Namely, when the switch 6 is opened again to turn Low and the switch controlling circuit 10 outputs a High signal $D_1$, measuring circuit 16, including measuring counter 11 etc., is reset. As a result, all of the electrical circuits are reset, and come to the zero condition. In this condition, the chronograph is ready for operating again. In the prior art when actuation of the switch and operation of electrical circuits do not correspond to each other, it is impossible to separate definitely the functions for correcting hand position by the switch and for CG measurement. In a case where the hand of the CG indicator goes out of the proper position, it is difficult for a wearer to correct the hand position. For example, a movement must be taken out of the watch case for replacing the hand or complex combinations of operations of push buttons are required.

In accordance with this invention, it is simple to reset the function from a condition in which the hand position is ready to be corrected to a condition in which the chronograph is operable. This operation corresponds to a condition wherein the switch is open.

(iii) Operation of the switch 6*c* that is, the external operational stem 6 is in the second pulled-out position 6*c*, is described below. By pulling the winding stem 6 to the position 6*c* in FIG. 2 the hour hand 5*c* and minute hand 5*b* are ready to be adjusted and the second hand 5*a* is ready to be corrected in like manner as a conventional analog display timepiece. Besides, in order to correct the time precisely in FIG. 1, a portion in the divider 2 relating to the time display can be reset.

At the position 6*c* of the switch, the switches 7, 8, 9 operate as in (i) and (ii). Herein, provided that CG is operative as in (i) wherein the switch 6*a* is open, operations of the measuring circuits 16, 17, 18 and the like, are all equal to those of condition (i) and need no further description here. The second hand 5*a* is regulated and the arbitrary time is corrected by adjusting an hour hand 5*c* and a minute hand 5*b* at the position of the winding stem 6*c*. Then, the winding stem is pushed from the position 6*c* to the position 6*a*. During this short time of pushing, though the winding stem 6 passes through the position 6*b*, the chronograph hand is not allowed to be correctable at the position 6*b* so long as the switches 7, 8, 9 are not supplied with an input. Therefore, the second hand 5*a* precisely commences hand movement at the same time that the winding stem 6*c* is pushed, whereby the time is precisely set as a normal time-piece.

(iv) How the chronograph hand and the time display hand are relevant to the electronic circuit at the time when the external operational stem 6 is pulled or pushed to the positions *6a, 6b* and *6c* is now explained. How AND gate 31 and FF 32 operate as a function of the switch 6 is described hereinbefore. The signal $D_1$ is High when the chronograph is operating and is Low when the chronograph is not operating. When the external stem member 6 is pulled from the position *6a* to the position *6b,* chronograph hands do not turn in the condition of correction, because an output is not delivered from the AND gate 31. The operation and feature of the chronograph hands in the correction condition of correction is described in (ii). When the winding stem 6 is subsequently pulled up to the position *6c* under the operation condition of the chronograph at the first pulled position *6b,* the signal applied through the switch *6c* is Low, whereby the output of AND gate 31 is Low. The gate *7a* continues to operate with the result that the chronograph maintains operation.

On the other hand, the second hand for time display is stopped to be regulated, whereby permitting the hour and the minute hand to get in a condition of correction. Namely, even if the winding stem is pulled up to the first and second pulled positions, the chronograph is not stopped from operating at those positions. Accordingly, when the winding stem is at the first pulled position, there are two cases, namely, that chronograph hands are not stopped, and that the chronograph hands are stopped to allow compensation. The feature is brought about as follows by not stopping the chronograph function at the first and the second pulled positions of the stem.

At the normal position of the stem, CG button 7 is pushed to start CG when the time is struck. Thus, the CG second hand agrees with the true time. Under this condition, the stem is pulled to the second pulled position, permitting correcting of the time. At the second pulled position of the stem, the second hand *5a* of time display is not necessarily to be set to the zero-position. After the hour hand and the minute hand are set to the present time, the stem is pushed from the position *6c* to the normal position *6a* when the CG second hand 24 agrees with the second hand *5a.* The second hand *5a* moves accurately with the CG second hand. Consequently, it becomes very easy to set the analog timepiece correctly.

On the other hand, in a conventional analog quartz timepiece, it takes time to set the time at every hour. To describe this in more detail, the external operational stem is pulled when the second hand comes to the zero-position. And the hour and the minute hand are rotationally corrected at every hour. After that the external operational stem is pushed. Accordingly, in a case where a watch is fast, the time is corrected after the announcement of time is struck. Or, in a case where a watch is slow, it takes about one minute to correct the time previously struck before the time is corrected. It necessarily takes more than several minutes to set the time precisely in so far as there is no other timepiece for standard time. According to this invention, the time is able to be set at a predetermined time because the second hand of the CG can be moved for the reference time while satisfying the time stroke.

There is a construction wherein a hand for indicating an ordinary time and a hand for the CG are used by changing over, whereby an analog-chronograph timepiece is provided. It seems simple to automatically reset the second hand of the chronograph by pushing the button after the elapsed time is measured in the chronograph. However, this is not suited for an electronic circuit because it requires a counter for counting the operation of the chronograph and a memory for the present time. Thus, complex electronic circuits such as a counter and a coincidence circuit are further required. As a result, the conventional structure is unsuitable for small-sized equipment of low power such as a wristwatch. In addition, it is troublesome to adjust the time in a manner similar to the conventional analaog quartz timepiece.

On the other hand, this invention is advantageous in that the hand of the CG remains moving even whem time correcting. The motors and the gear trains of the second hand *5a* for ordinary time display are independently constructed so that the elapsed time can be measured while confirming the present time. Moreover, it is simple to adjust the time. Or, even if the winding stem is in the condition *6b,* it is possible to arrange the circuit to allow the correction of the CG by stopping the CG when the switch 7 is pushed.

(v) The condition and operation of the switch 6 is described with making the position *6b* equal to the position *6c.* When the external stem member 6 is pulled by one step, the minute hand 5 is corrected by mechanically rotating the external stem member 6. At this time the second hand *5a* is stopped to be regulated. Simultaneously, the switches 7, 8 and 9 are ready for regulation of the CG hand. However, there is a disadvantage that the time is apt to be set wrong. And various operations of the external stem member, that is, pushing or pulling are required in order to set the precise time. First of all, after the external stem member is moved from the position *6a* to *6b,* the CG hand is set at the position 0. Then, the external stem member is once put back from the position *6b* to the position *6a* and the hand of the CG is set to the true time and put into the condition of hand movement. Next, when the external stem member is moved from the position *6b* to the position *6a,* the second hand and the CG second hand are made to correspond to each other.

When there is no calendar mechanism at the position *6b* of the external stem member, a watch is fabricated with less cost.

Herein, the disposition of the switches to operate the chronograph is described below. In FIG. 2, the push button 7 operates to start and stop measurement of elapsed time. The push button 8 operates to reset the CG indication, and the push button 9 operates to measure lap time. A conventional digital electronic timepiece is usually provided with a push button 7 for starting and stopping measurement of elapsed time and a push button 8 for resetting the CG indication and measuring the lap time. And in a digital display electronic timepiece using liquid crystal and the like, the present operation is able to be instantly displayed, hereby permitting a user to conceive the present operation. However, it is difficult to comprehend a complex operation such as a split measurement.

The object of this invention is to simplify operation by combination of the push buttons. A simple function such as the chronograph is allowed to be driven by the push buttons provided on the right side half. A complex function such as a split is provided on another part to completely separate the sampling function, namely, on the left half to avoid erroneous operation (FIG. 2). In a case where a split operation is not needed the button 9 can be taken off the instrument.

Chronograph indications are independently corrected corresponding to the push-pull buttons, so that the chronograph hands are very easily corrected. Besides, when repairing a watch at a conventional watch maker, shift of scale or flapping up and down of hands can be easily checked when the hand of the chronograph is attached to an indicator by hand feeding as a function of switch operation. By this switch operation, such a function as the chronograph can be used as a plurality of counters, because, the indicating hand is rotated by one step per one switch operation.

A timepiece of chronograph function can be easily offered with a counter function by providing the operation and correcting functions in accordance with this invention. In addition, in a case where a calendar function is attached to a chronograph function, in a generally analog timepiece, the calendar function is mechanically corrected whereas the time indication can be corrected similarly to a conventional analog timepiece.

Herein, driving signal timing of an electro-mechanical converter is described with reference to an analog display timepiece having a plurality of electro-mechanical converters.

Analog display timepieces having a plurality of step motors have been provided before, however, these are not practical. This is because of the large current flow required in simultaneously driving a plurality of step motors. A large battery is required to produce a large current. Such design is not suitable for a small sized device such as an analog display watch.

An object of this invention is to eliminate the above-mentioned disadvantages and to provide a small-sized timepiece and an analog display timepiece with a plurality of motors.

The structure of this invention is further described in detail with reference to an alternative embodiment. According to this embodiment, a time display and a stopwatch display are made at the same time. The hour and the minute hands of timekeeping and the second hand of timekeeping, the second hand of the stop-watch and the minute hand of the stop-watch are independently driven, respectively.

Figure 3:
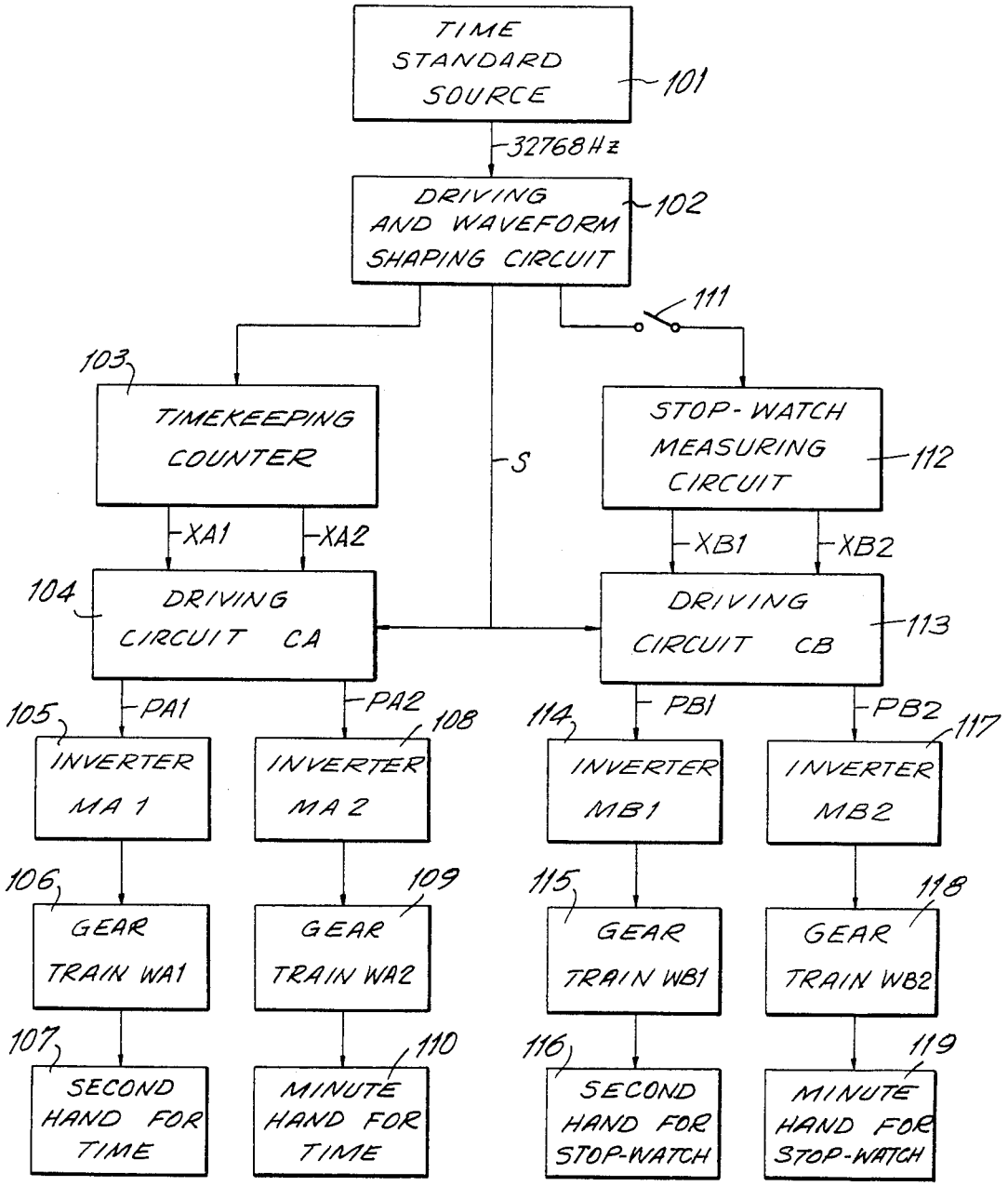
FIG. 3 is a block diagram of an alternative embodiment of an analog electronic timepiece in accordance with the invention.

FIG. 3 is a block circuit of an alternative embodiment in accordance with the invention. A time standard source 101 such as a micro, that is, small sized quartz crystal resonator or an oscillation circuit generates a time standard signal of 32,768 Hz. A divider or a wave form shaping circuit 102 divides the time standard signal of 32,768 Hz into a time signal of low frequency in shaping a signal necessary for the other circuit. The output of the divider and wave form shaping circuit 102 is applied to a stop-watch measuring circuit 112, and through a time keeping circuit 103 and a switch 111 for measuring stop-watch measured time and the time, respectively. The time-keeping circuit 103 outputs a second signal XA1 and a twenty seconds signal XA2 to input into the driving circuit CA 104. The driving circuit CA 104 generates a driving pulse PA1 corresponding to the signal XA1 and a driving pulse PA2 corresponding to the signal XA2 during the H level of the signals formed from the divider and wave form shaping circuit 102.

Stop watch time measuring circuit 112 outputs a one second signal XB1 and a signal of sixty seconds XB2 to apply to the driving circuit CB 113. The driving circuit CB 113 generates a driving pulse PB1 corresponding to XB1 and a driving pulse PB2 corresponding to XB2 during the High level of a signal S formed from the divider and wave form shaping circuit 102.

Figure 4:
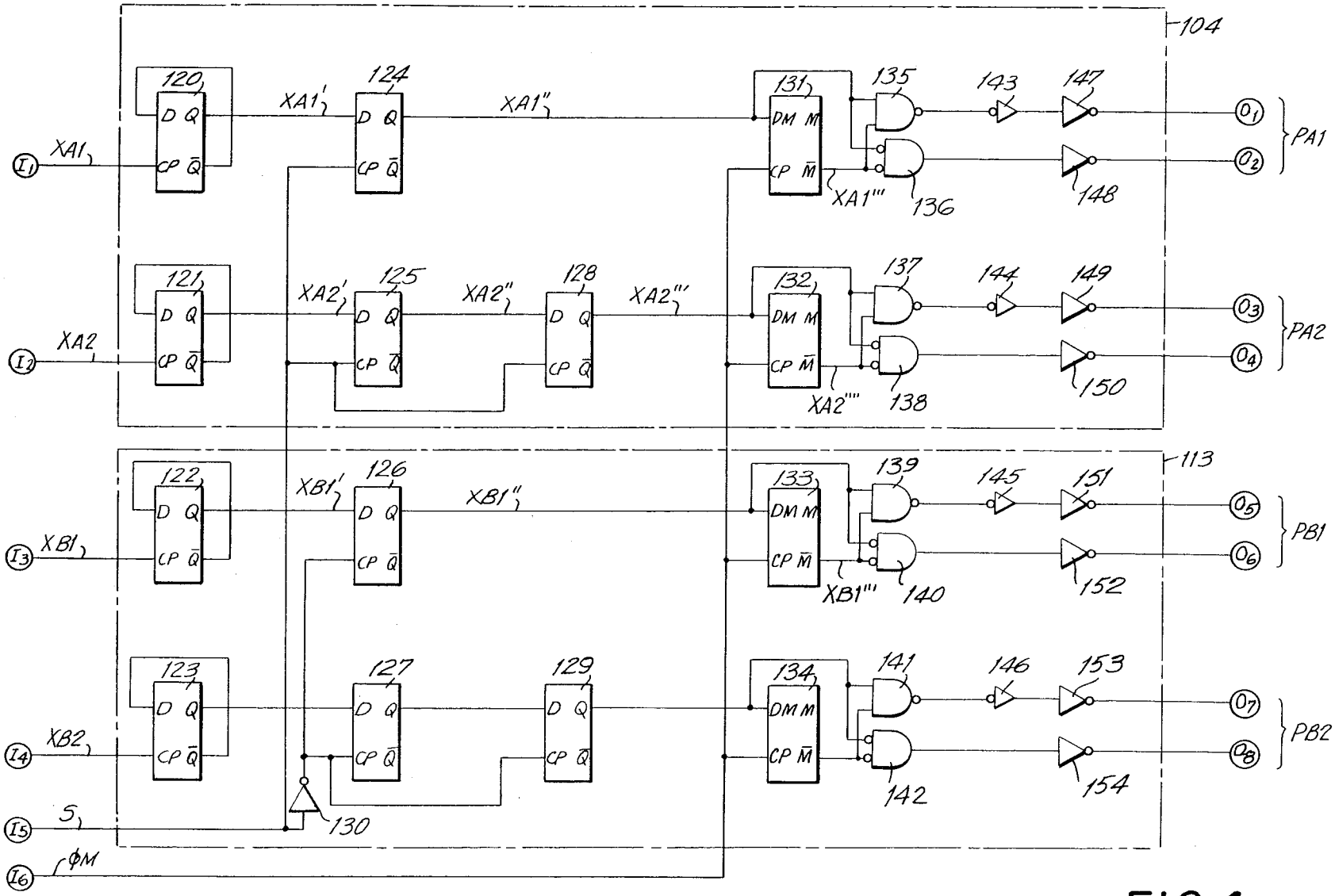
FIG. 4 is a driving circuit for the analog electronic timepiece of FIG. 3.
Figure 5:
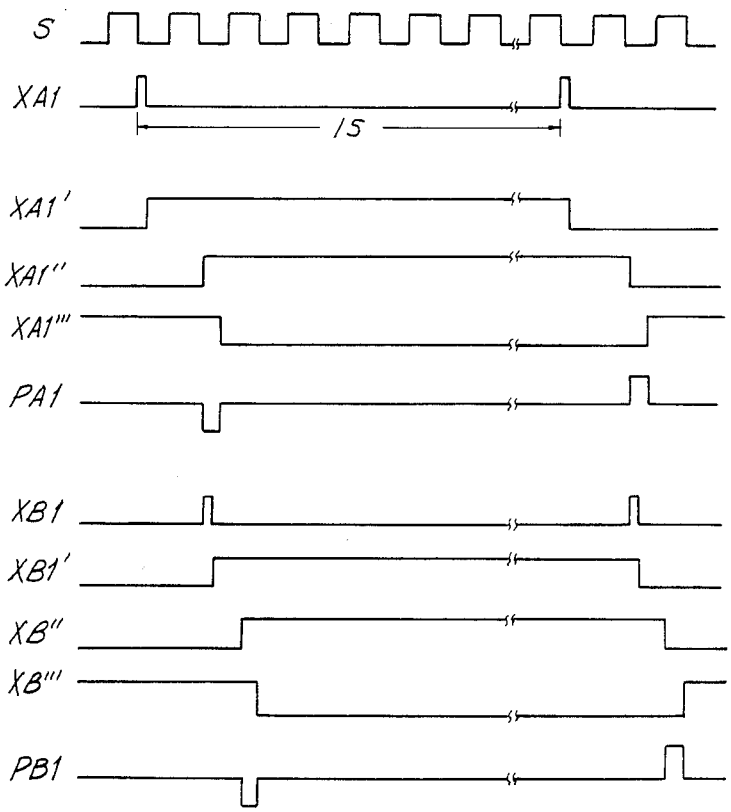
FIGS. 5 and 6 are timing waveforms associated with the circuit of FIG. 4.
Figure 6:
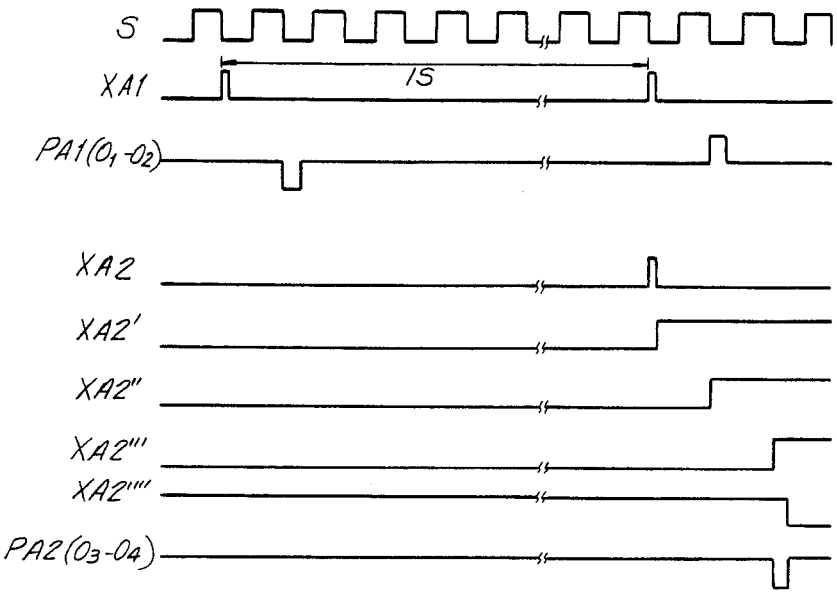

This alternative embodiment of the invention is further described by means of FIG. 4, 5 and 6.

FIG. 4 is an actual construction including driving circuits CA 104 and CB113. The circuit includes master slave flip-flops (hereinafter referred to as FF) 120, 121, 122, 123, 124, 125, 126, 127, 128, 129, wherein the outputs Q and $\overline{Q}$ vary in synchronism with the fall of the clock pulse inputted to the terminal CP. Also included are latch circuits 131, 132, 133 and 134 which pass data DM when the level of the clock pulse inputted to the terminal CP is "H" and hold the data DM when the level of clock pulse inputted to the terminal CP is Low. Also included are NAND gates 135, 137, 139, 141, NOR gates 136, 138, 140 and 142, inverters 130, 143, 144, 145, 146, and drivers and inverters 147, 148, 149, 150, 151, 152, 153, 154 for supplying enough current to drive the step motors.

Referring now to FIG. 4, operation is described with reference to the timing charts of FIGS. 5 and 6. A differential signal XA1 of 1 Hz whose pulse width is 0.98 msec is delivered from the timekeeping circuit 103 via a terminal I1 to the flip-flop 120. The output XA1′ of FF 120 is divided and has a frequency of ½ Hz and input to a terminal D of FF124. FF124 outputs a signal XA1″ until the fall of a signal S of 64 Hz formed by the dividing and waveform shaping circuit 102. The signal XA1″ is inputted to a terminal DM of the latch circuit 131 and delayed by 1/256 sec to be the signal XA1‴ by means of a signal $\phi$M of 128 Hz delivered from a terminal I6 into the other terminal CP of the latch circuit 131. The signals XA1″ and XA1‴ are inputted to a terminal O1 through NAND gate 135 and to another terminal $O_2$. A driving pulse PA1 having a pulse width of 39 msec is output between the terminals $O_1$ and $O_2$. The driving pulse PA1 is necessarily outputted during the Low of the signal S for the driving pulse PA1 is outputted in synchronization with the rise and fall of the signal $XA_1''$, and the signal $XA_1''$ is varied in synchronization with the fall of the signal S.

By similar logic, a differential signal $XB_1$ of 1 Hz whose pulse width is 0.98 msec is delivered from the stopwatch timekeeping circuit 112 via terminal $I_3$. A driving pulse $PB_1$ corresponding to the signal $XB_1$ comes in synchronization with the rise and fall of a signal $XB_1''$ at the terminals $O_5$ to $O_6$. The driving pulse $PB_1$ is necessarily outputted during the High of the signal S for the driving pulse $XB_1''$ changes in synchronization with the rise of the signal S.

Also by similar logic a differential signal $XA_2$ of 1/20 Hz whose pulse width is 0.98 msec is inputted from the timekeeping circuit 103 once in twenty seconds at the same timing as the signal $XA_1$. And the driving pulses $PA_2$ output at the terminals $O_3$ to $O_4$, in synchronization with the rise and fall of a signal $XA_2'''$, are necessarily outputted during a Low period of the signal S. The driving pulse $PA_2$ is never outputted at the same time as the driving pulse PA1.

Further, a differential signal $XB_2$ of 1/60 Hz whose pulse width is 0.98 msec is inputted into a terminal $I_4$ from the stopwatch timekeeping circuit 112 at the same timing as the signal $XB_1$, that is, once in sixty seconds. A driving pulse $PB_2$ across terminals $O_7$ and $O_8$ is delayed as compared to $PB_1$ for the period of signal S.

As described above, whenever a stopwatch second signal $XB_1$ and a stopwatch minute signal $XB_2$ are outputted against a one second signal $XA_1$ and a twenty seconds signal $XA_2$ delivered from the timekeeping circuit 103, the respectively corresponding driving pulses $PA_1$, $PA_2$, $PB_1$ and $PB_2$ are never output at the same time.

In the embodiments described herein, presented by way of example, a stopwatch function have been utilized as a supplemental function, but it should be clear that the invention is applicable to other functions so long as it is analog display, such as a timer and dual time watch. Exchange of the stopwatch timekeeping circuit for a respectively exclusive timekeeping circuit allows the timer or dual-time functions.

Additionally, in the embodiment described herein, two individual step motors have been described in order to display an elapsed measurement by the stop watch function. It is also within the scope of the invention to use many more step motors.

In accordance with the invention, in a timepiece having a plurality of step motors for displaying the time and a plurality of step motors for displaying supplemental functions other than the time, the plurality of step motors are not driven simultaneously even if the supplemental function is driven concurrently with normal timekeeping display. Thus, voltage reduction in a small sized power source is prevented as the peak current drain is far less than when motors are simultaneously driven. As a result, the circuitry remains normally operating and a transducer, such as a crystal resonator, is free from erroneous operation. Under these circumstances, this invention offers a small-sized timepiece of many functions with high accuracy and reliability, thereby permitting great potential for practical use.

Moreover, as stated above, a user can operate the chronograph function without experiencing the problems of complexity generaly caused by external button functions acting on the electronic circuits. Even in an analog timepiece, many functions can be provided, dispensing with complex explanations of the various operations by the external operational members. This invention permits the production of an analog timepiece which has many functions but which is easy to operate and is therefore available for practical use.

What is claimed is:

1. An analog electronic timepiece having multiple functions comprising: a standard frequency signal generator, a divider network receiving the standard signal output of said generator and outputting signals of lower frequency, one said lower frequency signal being a timekeeping signal, an analog display for timekeeping having a timekeeping indicator hand connected to a timekeeping motor, timekeeping motor driving means for receiving said timekeeping signal and outputting timekeeping driving signals to said timekeeping motor, a power source for electrically powering all electrical components of said timepiece;

at least one supplemental motor, each said at least one supplemental motor being connected respectively to a supplemental indicator hand;

supplemental motor driving means receiving signals from said divider network and outputting supplemental driving signals respectively to said at least one supplemental motor;

switch means for independently starting and stopping each said at least one supplemental motor, said timekeeping function being unaffected by operation of said switch means;

external actuating means for selectively actuating said switch means by selective operation of said external actuating means;

phase control means for receiving said frequency outputs of said divider and for shifting the phases therebetween, said phase-shifted signals being input to said timekeeping and supplemental motor driving means, respectively, said timekeeping motor never being driven concurrently with any of said at least one supplemental motor, peak current drain from said power source being less than for concurrent motor driving.

2. An analog electronic timepiece as claimed in claim 1, and further comprising means for independently correcting the position of each of said at least one respective supplemental indicator hands said correction being implemented by operation of said external actuating means.

3. An analog electronic timepiece as claimed in claim 2, wherein said timepiece includes said timekeeping function and a chronograph function using said at least one supplemental motor and supplemental indicator hand, each said at least one supplemental hand indicating one of a unit of time, subdivision and accumulation thereof, and further comprising means for counting said signals from said divider network and for counting said driving signals applied to the associated supplemental motor, and comparison means for comparing said counts, said means for correcting being adapted to move the associated supplemental indicating hand while maintaining the count in both said counters equal, each said hand being independently set to any desired position on the dial including the zero position.

4. An analog electronic timepiece as claimed in claim 3, and further comprising circuit control means for driving said at least one supplemental motor in selected frequency modes, one mode being applied for driving when said comparison means indicates coincidence in signal counts and a second mode being applied for driving when said comparison means indicates an inequality.

5. An analog electronic timepiece as claimed in claim 3, wherein said equal counts are zero.

6. An analog electronic timepiece as claimed in claim 1, wherein said switch means is in circuit between said divider network and said supplemental motor driving means.

7. An analog electronic timepiece as claimed in claim 1, and further comprising switch means and associated external actuating means for selectively correcting said timekeeping indicator.

8. An analog electronic timepiece as claimed in claim 1 wherein there are at least two supplemental motors and supplemental indicator hands.

9. An analog electronic timepiece as claimed in claim 8, and further comprising means for independently correcting the position of each of said at least one respective supplemental indicator hands said correction being implemented by operation of said external actuating means.

10. An analog electronic timepiece as claimed in claim 1, wherein there are three supplemental motors and three supplemental indicator hands.

11. An analog electronic timepiece having multiple functions and including a standard frequency signal generator, a divider network receiving the standard signal output of said generator and outputting signals of lower frequency, one said lower frequency signal being a timekeeping signal, an analog display for timekeeping having a timekeeping indicator hand connected to a timekeeping motor, timekeeping motor driving means for receiving said timekeeping signal and outputting timekeeping driving signals to said timekeeping motor, a power source for electrically powering all electrical components of said timepiece;

at least two supplemental motors, each said at least two supplemental motors being connected respectively to a supplemental indicator hand;

supplemental motor driving means receiving signals from said divider network and outputting supplemental driving signals respectively to each said at least two supplemental motors;

switch means for independently starting and stopping each said at least two supplemental motors, said timekeeping function being unaffected by operation of said switch means;

external actuating means for selectively actuating said switch means by selective operation of said external actuating means; and means for independently correcting the position of said respective supplemental indicator hands said correction being implemented by operation of said external actuating means.

12. An analog electronic timepiece as claimed in claim 11 and further comprising switch means and associated external actuating means for selectively correcting said timekeeping indicator.

13. An electronic timepiece as claimed in claim 11, wherein there are three supplemental motors and three supplemental indicator hands.

14. An analog electronic timepiece as claimed in claim 11, wherein said timepiece includes said timekeeping function and a chronograph function using said at least two supplemental motors and supplemental indicator hands, each said supplemental hand indicating one of a unit of time, subdivision and accumulation thereof, and further comprising means for counting said signals from said divider network and for counting said driving signals applied to the associated supplemental motor, and comparison means for comparing said counts, said means for correcting being adapted to move the associated supplemental indicating hand while maintaining the count in both said counters equal, each said hand being independently set to any desired position on the dial including the zero position.

15. An analog electronic timepiece as claimed in claim 14, and further comprising circuit control means for driving said at least two supplemental motors in selected frequency modes, one mode being applied for driving when said comparison means indicates coincidence in signal counts and a second mode being applied for driving when said comparison means indicates an inequality.

16. An analog electronic timepiece as claimed in claim 14, wherein said equal counts are zero.

17. An analog electronic timepiece as claimed in claim 11, wherein said switch means is in circuit between said divider network and said supplemental motor driving means.

* * * * *